US005587622A

United States Patent [19]

Mohacsi

[11] Patent Number: 5,587,622

[45] Date of Patent: Dec. 24, 1996

[54] LOW PRESSURE GAS DISCHARGE LAMPS WITH LOW PROFILE SEALING COVER PLATE

[75] Inventor: Ferenc Mohacsi, Kalamazoo, Mich.

[73] Assignee: Fallon Luminous Products, Spartanburg, S.C.

[21] Appl. No.: 273,713

[22] Filed: Jul. 12, 1994

[51] Int. Cl.[6] ..... H01K 3/22; H01J 9/26

[52] U.S. Cl. ..... 313/493; 313/573; 313/634; 445/25; 220/2.2

[58] Field of Search ..... 313/493, 573, 313/634; 445/25; 220/2.2

[56] References Cited

U.S. PATENT DOCUMENTS 4,119,378 10/1978 Kupsky ..... 445/25
4,182,540 1/1980 Frankland ..... 445/25
4,582,210 4/1986 Morimoto et al. ..... 313/573
4,770,310 9/1988 Morimoto et al. ..... 220/2.2
5,059,148 10/1991 McKenna et al. ..... 445/25

*Primary Examiner*—Sandra L. O'Shea
*Assistant Examiner*—Vip Patel
*Attorney, Agent, or Firm*—Hardaway Law Firm, PA

[57] ABSTRACT

A low pressure gas discharge lamp has a low profile which includes at least one glass plate with a tube envelope channel having a cover plate covering the evacuation tube which is substantially flush with the plate.

5 Claims, 2 Drawing Sheets

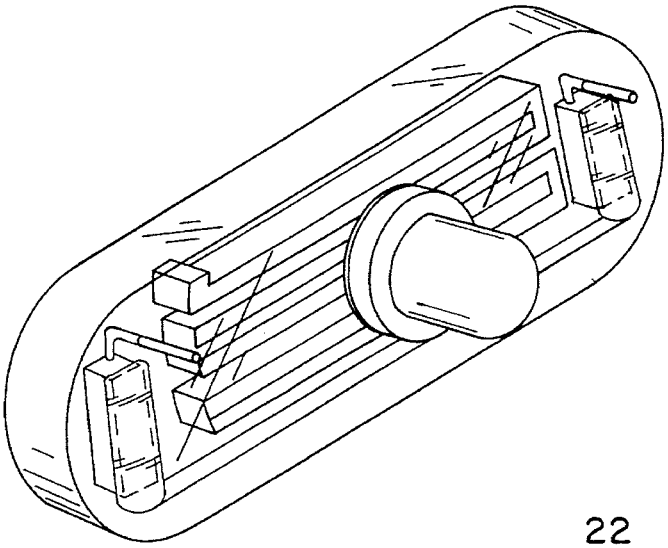
FIG. 1
PRIOR ART
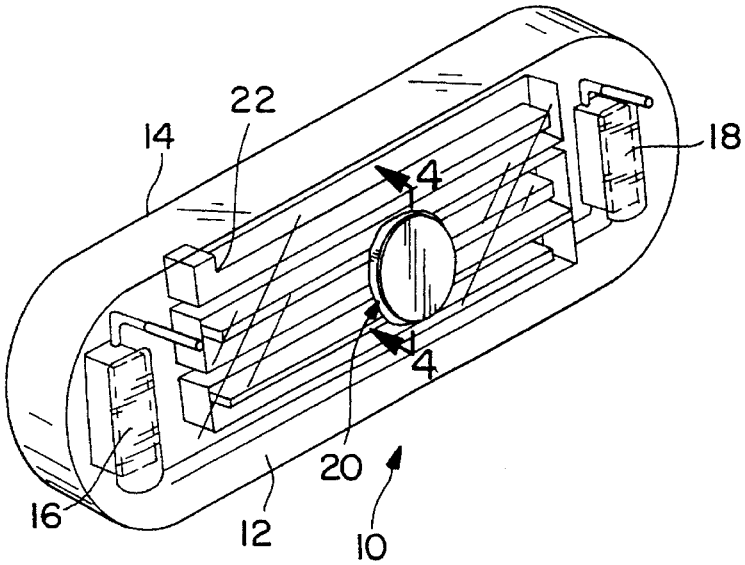
FIG. 2
FIG. 3
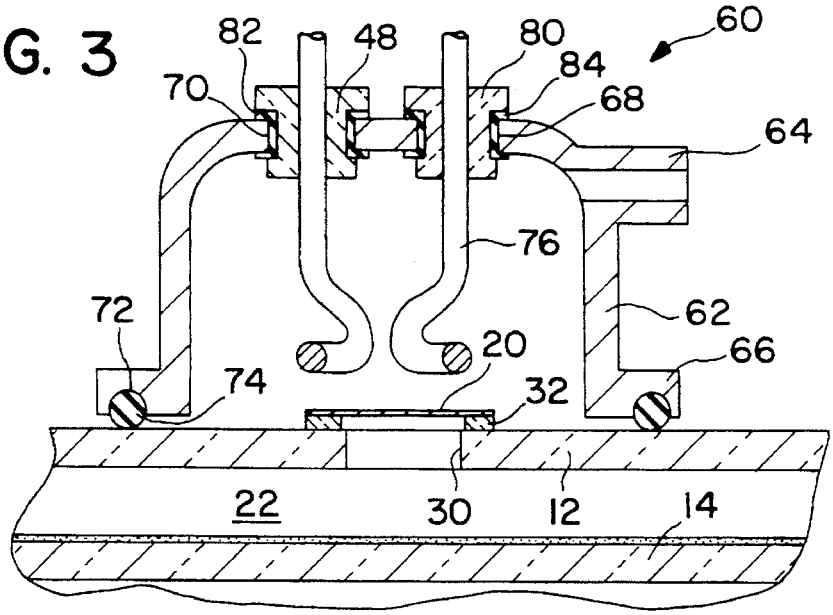

LOW PRESSURE GAS DISCHARGE LAMPS WITH LOW PROFILE SEALING COVER PLATE

BACKGROUND AND SUMMARY OF THE INVENTION

The present invention relates to low pressure gas discharge lamps and, more particularly, to a method of hermetically sealing vacuum ports in low pressure gas discharge lamps or bulbs and the products of the method.

Type of flat plate illumination display lamps exist in the field. Examples of these lamps or bulbs are illustrated in U.S. Pat. Nos. 4,584,501 entitled "Flat Plate Luminous Display Device", issued Apr. 22, 1986; 4,990,826, entitled "Low Voltage Gas Discharge Device", issued Feb. 5, 1991; 5,036,243, entitled "Glass Plate Illumination Device Sign with Integral Electrodes of Particular Thermal Resistance", issued Jul. 30, 1991; and 5,066,257, entitled "Process for Producing Flat Plate Zllumination Devices", issued Nov. 19, 1991, the specifications and drawings of each are herein expressly incorporated by reference. These flat plate lamps are manufactured by different methods and all illustrate varying elements. However, one element which all of the flat plate lamps have in common is an evacuation tube which extends from the flat plate to enable drawing of a vacuum from within the lamp and acts as an entrance port toy rare gases.

During the final processing of the low pressure gas discharge lamps, the lamps are evacuated, filled with the appropriate rare gases, and are hermetically sealed. In practice, this process is done through a relatively small diameter glass chip or tube which is added to the lamp plate by fusing it or soldering it, with a special low melting temperature glass, to the plate. Ordinarily, this solder and tube have an expansion coefficient which is equal to that of the glass plate.

After processing the lamp, the evacuation tube or chip is heated to a softening point whereby the relative vacuum within the lamp channel collapses the wall of the tube and fuses the tube sides together to become solid and thus, vacuum tight. The excess glass is removed, leaving a relatively short piece of evacuation tube extending from the lamp. This piece of the evacuation tube is highly fragile and requires physical protection from damage, which damage in every case will result in lamp failure.

In the case of fluorescent tubes, the remains of the evacuation tube, which is sometimes referred to as tip offs, are protected by the lamp cap which also acts as an electrical connection to the cathodes. When the lamps area not tubular, but formed in a glass plate or other designs, the evacuation tube is added to one of the plates and after processing, the tube extends from the same plate adding extra dimensional length to the lamp as well as requiring a physical protection, such as a cap which is seen in FIG. 1.

Also, in a number of processes, a getter is added to the lamp which is activated after the lamp has been fully processed. The getter's function is that of a chemical sponge to absorb and neutralize contaminants which would effect the proper functioning of the lamps. In order to activate the getter, it must be heated to an elevated temperature for a given period of time during which the absorption of undesirable elements such as hydrogen, oxygen and the like elements which it is designated for, takes place.

As mentioned above, these prior lamps, while working satisfactorily for their intended purpose, have an additional thickness created by the cap protector on the evacuation tube. Thus, it would be desirable to provide a low profile, low pressure gas discharge lamp having a substantially flush cover which enables the lamp to hang substantially parallel with a holding surface.

It is an object of the present invention to provide such a lamp and a method of making the same. The present invention provides the art with a low profile, low pressure gas discharge lamp or bulb having extremely high physical integrity. Also, the present invention has a cover plate which is hermetically sealed with the glass plate providing a vacuum tight seal.

The invention provides a cap which may be coupled with a getter so that the getter may easily be applied and activated within the lamp. Further, the present invention replaces the evacuation tube with a metallic cover. The cover has substantially the same coefficient of expansion as the glass plate of the lamp. The present invention provides a method for carrying out the manufacturing of such a plate glass lamp.

From the following detailed description taken in conjunction with the accompanying drawings and subjoined claims, other objects and advantages of the present invention will become apparent to those skilled in the art.

BRIEF DESCRIPTION OF THE DRAWINGS

FIG. 1 is a rear perspective view of a prior art glass plate illumination lamp.

FIG. 2 is a rear perspective view of a low pressure gas discharge lamp in accordance with the present invention.

FIG. 3 is a cross sectional view of the vacuum mechanism utilized with the present invention.

DETAILED DESCRIPTION OF THE PREFERRED EMBODIMENT

Figure 4:
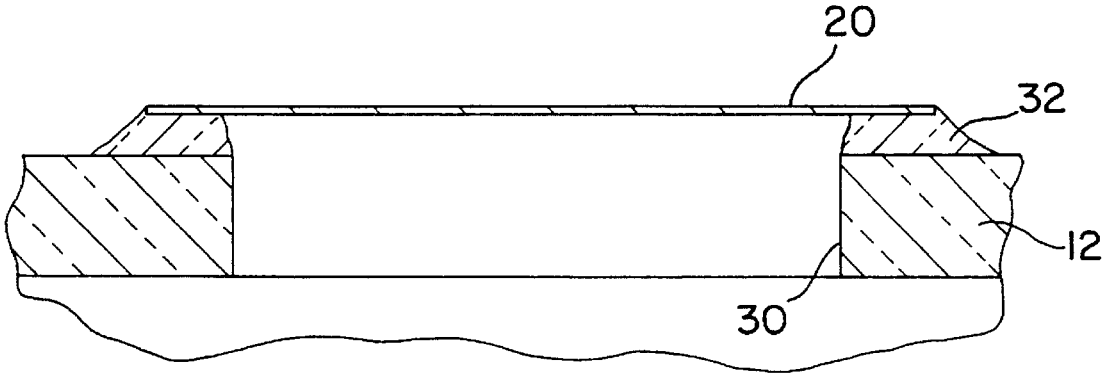
FIG. 4 is an enlarged partial cross sectional view of FIG. 1 along lines 4—4 thereof.

Referring to the figures, particularly FIGS. 2 through 6, a low pressure gas discharge illumination lamp is illustrated and designated with the reference numeral 10. The lamp 10 includes a first glass plate 12, a second glass plate 14, electrodes 16 and 18 and a cover plate 20. One of the glass plates 12 or 14 includes a channel 22 which defines the evacuated light tube envelope. Additional electrical elements, not shown, such as transformers and the like are connected to the leads of the cold cathode electrodes 16 and 18. Also, the lamp may be produced as defined in U.S. Pat. No. 5,066,257, entitled "Process for Producing Flat Plate Illumination Devices", issued Nov. 19, 1991, the specification of which is herein expressly incorporated by reference. This process may be utilized to produce the illumination lamp up to the step of providing an evacuation means in evacuating the lamp tube envelope.

Figure 5:
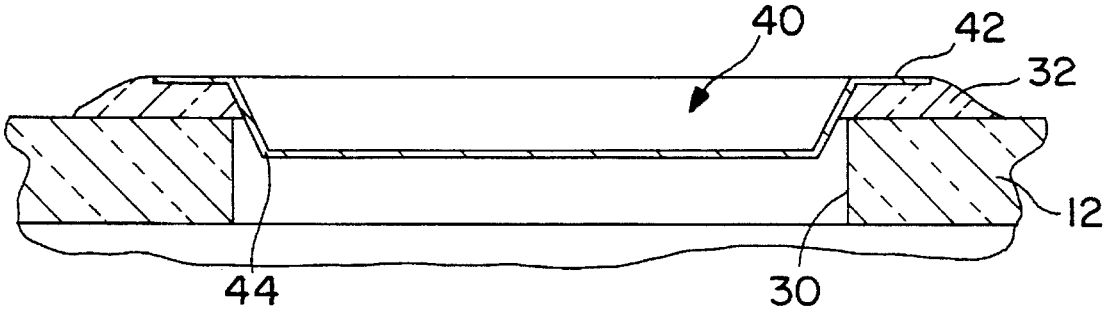
FIG. 5 is a figure like that of FIG. 4 of another embodiment of the present invention.
Figure 6:
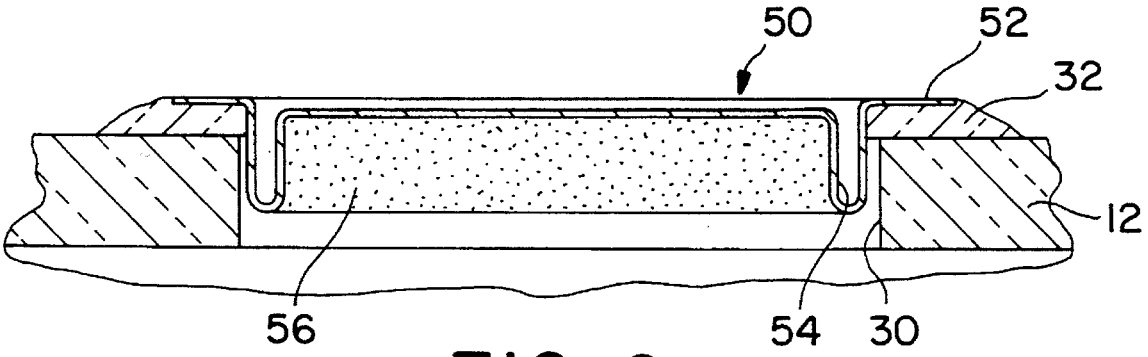
FIG. 6 is a figure like that of FIG. 4 of another embodiment of the present invention.

Turning to FIGS. 4 through 6, various types of covers are shown. FIG. 4 illustrates the cover illustrated in FIG. 2. As can be seen, the cover 20 covers an evacuation port 30 and the cover 20 is secured to the glass plate 12 by glass solder 32. The cover plate 20 has an overall disc shape and is substantially flat. The cover plate 20 has a desired thickness, generally in the area of about 0.020" to about 0.250". The cover plate 20 has an expansion coefficient of about $8.6\times 10^{-6}$ $K^{-1}$, which is substantially equal to the expansion coefficient of the glass plate 12. Materials which may be utilized for the cover plate 20 are Alloy 48, Vacquit 501 and Nilo 48. The cover plate 20, once bonded via the solder 32 to the glass plate 12, is substantially flush with the plate 12, providing a low profile low pressure gas discharge lamp.

FIG. 5 illustrates an additional embodiment of the present invention. In FIG. 5, the cover plate 40 has an overall disk shape in plan with a flange rim 42 and a dome portion 44. The dome portion 44 has a conical shape enabling easy locating of the cover 40 into the evacuation port 30. Other than the configuration of the cover plate 40, the physical characteristics such as coefficient of expansion, thickness and material, are the same as those previously described.

FIG. 6 illustrates yet another embodiment of a cover plate 50 in accordance with the invention. The cover plate 50 has an overall disc shape with a rim flange 52 and an extending circular lip 54. A getter 56 is affixed to the plate 50 within the lip 54. The lip 54 has a diameter slightly less than the diameter of the evacuation port so that the cover fits into the evacuation port 30 as shown in FIG. 6.

The getter 56 is used to chemically absorb and neutralize contaminants which are within the tube envelope. The getters 56 are generally formed of a zeolite material and are designed to remove contaminants such as oxygen, hydrogen, carbon monoxide or the like. Getters are generally manufactured by Seas Getters of Italy and are available from such manufacturer. The getter acts as a chemical sponge absorbing the chemicals and further may be formed of zirconium compounds. The getter 56 is heat activated. Upon heating of the getter 56, the undesirable contaminants are absorbed by the getter 56. Also, since the getter 56 is part of the cover plate, when the cover plate is heated in order to hermetically seal the glass, the getter is simultaneously activated.

The glass solder 32 ordinarily used in the operation is that of soda glass having a melting point substantially less than the melting point of the metallic cover 20, 40, 50. The solder 32 starts out as a solid in a ring form, as seen in FIG. 3, and is positioned about the evacuation port 30. The solder 32 is melted, which enables it to hermetically seal the cover 20 with the glass plate 12. The glass solder 32 ordinarily has a coefficient of expansion substantially the same as the glass plate and cover.

Moving to FIG. 3, a device for evacuating the glass plate 12 is shown. The vacuum device 60 includes a cup shaped housing 62 having a port 64, flange 66 and apertures 68 and 70. The port 64 is connected to a vacuum hose, not shown, which is secured by conventional means. The flange 66 has a groove 72 enabling an O ring 74 or the like sealer to be positioned therein to seal the cup 62 with the plate 12. A heating element 76 extends through the apertures 68 and 70. A pair of insulators 78 and 80 are sealed, via gaskets 82, 84 to the cap 62 and to the heating element 76. The heating element 76 may be of the radio frequency, eddy current, microwave, ultrasonic or laser type. The remainder of the heating element 76 is not shown.

A method of producing a lamp in accordance with the present invention is as follows. The lamp may be produced like that disclosed in U.S. Pat. No. 5,066,257, or like that disclosed in my copending U.S. patent application Ser. No. 254,138, entitled "Gas Discharge Light", filed on Jun. 6, 1994, the specification and drawings of which are herein expressly incorporated by reference.

Producing the lamp is substantially the same as that disclosed in the above references, except when it comes to evacuating the tube envelope, adding the rare gases to the lamp and sealing the evacuation port. The method of evacuating the envelope and filling it with the rare gases and producing the lamp in accordance with the invention will be described below.

A glass plate illumination lamp is provided having at least one glass plate 12 and a channel 22 defining a tube envelope within the plate. A pair of electrodes or cathodes 16, 18 are in the channel 22 with leads extending therefrom. An evacuation port 30 in association with the channel 22 is bored into the glass plate 12. A glass solder ring 32 is positioned about the glass evacuation port 30. A metallic cover 20 is positioned on top of the glass solder ring 132.

The vacuum mechanism 60 is placed onto the glass plate surrounding the cover 20 and glass solder ring 32. A vacuum is drawn via port 64 to evacuate the tube envelope 22. Upon evacuation of the tube envelope, while still drawing a vacuum, rare gases are injected into the tube envelope-via the port 64. After a sufficient amount of rare gas enters into the tube envelope, the heating coil 76 is activated. The activation of the heating coil 76 causes the metallic plate 20 to heat up which, in turn, causes the glass solder ring 32 to melt. Upon melting, the glass solder ring 32 bonds the plate 20 to the glass plate 12, as illustrated in FIGS. 4 through 6. At this time, the plate 20 is affixed with the glass plate 12 and hermetically seals the tube envelope of the lamp 10. The glass plate 12 and solder 32 are allowed to cool then the vacuum mechanism 60 is removed from the glass plate 12. Since the solder 32 and glass plate 12 have substantially the same expansion coefficient, upon cooling, a vacuum tight seal is provided on the low profile glass lamp which has extremely high physical integrity.

Also, if desired, a cover including a getter 56, like that shown in FIG. 6, may be utilized in the invention. Upon heating the cover 50, the getter 56 would be activated which, in turn, would remove the contaminants from within the tube envelope.

While the above detailed description describes the preferred embodiment of the present invention, the invention is susceptible to modification, variation, and alteration without deviating from the scope and fair meaning of the subjoined claims.

I claim:

1. A low pressure gas discharge lamp comprising:

at least one flat glass sheet including illumination means, said at least one flat glass sheet having an evacuation port;

a thin cover covering said evacuation port and hermetically secured to said at least one flat glass sheet forming the low pressure gas discharge lamp;

wherein a getter is secured to said thin cover.

2. The low pressure gas discharge lamp according to claim wherein glass solder bonds said thin cover with said glass sheet.

3. The low pressure gas discharge lamp according to claim 2 wherein said cover and said at least one glass sheet have substantially equal coefficiencies of expansion.

4. The low pressure gas discharge lamp according to claim 2 wherein said cover is a flat metallic plate.

5. The low pressure has discharge lamp according to claim 2 wherein said cover has a hollowed portion extending into said at least one glass sheet.

* * * * *